US009950891B2

(12) United States Patent
Mallahan, III

(10) Patent No.: US 9,950,891 B2
(45) Date of Patent: Apr. 24, 2018

(54) TAPE CUTTING DEVICE

(71) Applicant: Lee G. Mallahan, III, Bossier City, LA (US)

(72) Inventor: Lee G. Mallahan, III, Bossier City, LA (US)

( * ) Notice: Subject to any disclaimer, the term of this patent is extended or adjusted under 35 U.S.C. 154(b) by 182 days.

(21) Appl. No.: 14/961,143

(22) Filed: Dec. 7, 2015

(65) Prior Publication Data

US 2017/0113895 A1 Apr. 27, 2017

Related U.S. Application Data

(63) Continuation-in-part of application No. 13/848,539, filed on Mar. 21, 2013, now Pat. No. 9,206,011.

(51) Int. Cl.
*B65H 35/00* (2006.01)

(52) U.S. Cl.
CPC ..... *B65H 35/0026* (2013.01); *B65H 35/002* (2013.01); *B65H 35/008* (2013.01)

(58) Field of Classification Search
CPC ... B26F 3/00; B26F 3/02; B65H 35/04; B65H 35/0026; B65H 35/0006; B65H 35/0013; B65H 35/002; B65H 35/0033; B65H 35/0073; B65H 35/008; B65H 16/00; B65H 16/02; B65H 16/06; Y10T 225/20; Y10T 225/238; Y10T 225/246; Y10T 225/247; Y10T 225/256; Y10T 225/257; Y10T 225/259; Y10T 225/26; Y10T 225/203; Y10T 225/225; Y10T 225/229; Y10T 156/1052; Y10T 156/12; Y10T 156/1365
See application file for complete search history.

(56) References Cited

U.S. PATENT DOCUMENTS

| | | | | |
|---|---|---|---|---|
| 2,655,214 | A * | 10/1953 | Van Cleef | B65H 35/008 225/65 |
| 2,717,641 | A * | 9/1955 | Wiederspan | B65H 35/008 225/65 |
| 2,788,181 | A * | 4/1957 | Anderson | B65H 35/0026 225/65 |
| 4,711,384 | A | 12/1987 | Harris | |
| 4,957,234 | A * | 9/1990 | Orlandini | B65H 35/008 225/56 |
| 7,861,904 | B1 * | 1/2011 | Taylor | B65H 35/0026 225/65 |
| 8,443,862 | B1 | 5/2013 | Manabat | |
| 2010/0084450 | A1 | 4/2010 | Vulpitta | |

(Continued)

OTHER PUBLICATIONS

International Search Report issued in International Application No. PCT/US2016/065190 dated Mar. 20, 2017; 4 pages.

*Primary Examiner* — Phong Nguyen
(74) *Attorney, Agent, or Firm* — R. Keith Harrison; Fish & Richardson P.C.

(57) ABSTRACT

A tape cutting device includes a tape cutting unit adapted to ride along a tape roll. The tape cutting unit includes a device panel. A pair of spaced-apart tape roll guides extend from the device panel. A tape cutting blade having a tape cutting edge extends between the tape roll guides. A pair of tape bending tabs extends from the tape roll guides, respectively, toward each other and in spaced-apart relationship to the tape cutting edge of the tape cutting blade. A retaining mechanism is carried by the tape cutting unit. The retaining mechanism is adapted to secure the tape cutting unit on the tape roll.

18 Claims, 18 Drawing Sheets

(56) References Cited

U.S. PATENT DOCUMENTS

| | | | | |
|---|---|---|---|---|
| 2012/0006497 | A1 | 1/2012 | Vulpitta | |
| 2013/0306697 | A1 | 11/2013 | Lee | |
| 2014/0124145 | A1* | 5/2014 | Parkhe | B65H 35/0026 156/527 |

* cited by examiner

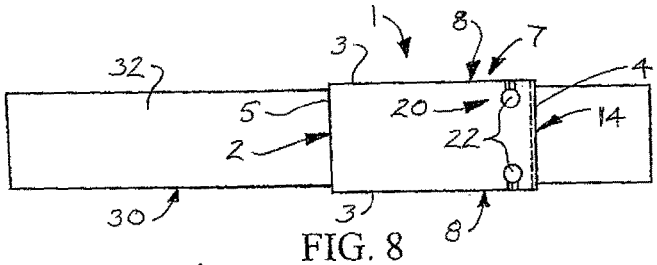
FIG. 8
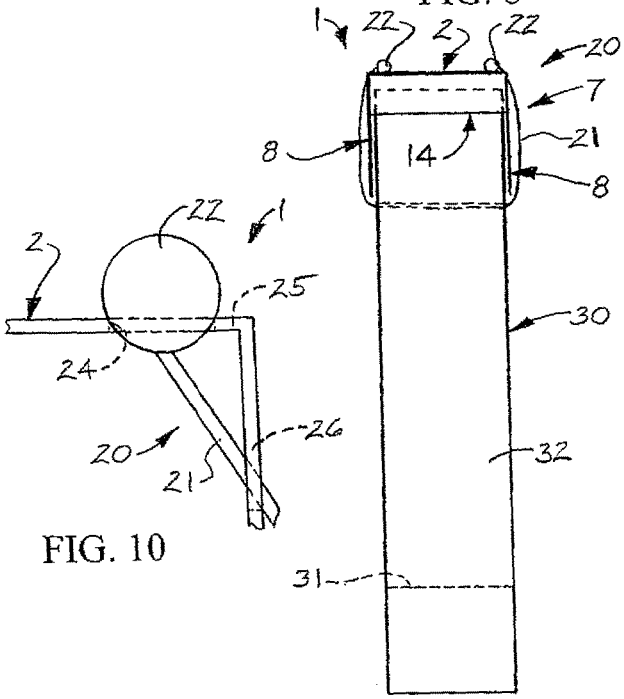
FIG. 9
FIG. 10
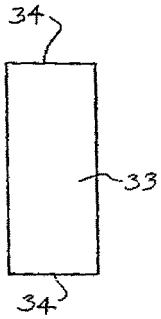
FIG. 11
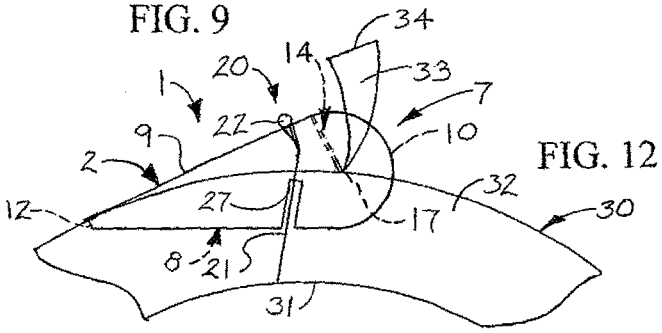
FIG. 12

TAPE CUTTING DEVICE

CROSS-REFERENCE TO RELATED APPLICATIONS

This application is a continuation-in-part of co-pending parent application Ser. No. 13/848,539, filed Mar. 21, 2013 and entitled TAPE CUTTING DEVICE, which parent application is incorporated by reference herein in its entirety.

FIELD

Illustrative embodiments of the disclosure relate to devices for cutting adhesive tape. More particularly, illustrative embodiments of the disclosure relate to a roll-riding tape cutting device which can be used to cut tape segments of selected lengths and/or straight edges from adhesive tape wound on a tape roll.

BACKGROUND

Adhesive tape is commonly dispensed from a continuous tape roll having a cylindrical spool on which the tape is wound. In some applications, it may be desirable to obtain segments of tape having uniform lengths and/or straight edges. The tape segments are typically torn from the wound tape on the roll, however, with the result that the lengths and edges of the tape segments are often irregular, haphazard and non-uniform.

Accordingly, a roll-riding tape cutting device which can be used to cut tape segments of selected lengths and/or straight edges from adhesive tape wound on a tape roll may be desirable for some applications.

SUMMARY

Illustrate embodiments of the disclosure are generally directed to a tape cutting device for cutting tape segments from tape wound on a tape roll. An illustrative embodiment of the tape cutting device includes a tape cutting unit adapted to ride along the tape roll. The tape cutting unit includes a device panel. A pair of spaced-apart tape roll guides extend from the device panel. A tape cutting blade having a tape cutting edge extends between the tape roll guides. A pair of tape bending tabs extends from the tape roll guides, respectively, toward each other and in spaced-apart relationship to the tape cutting edge of the tape cutting blade. A retaining mechanism is carried by the tape cutting unit. The retaining mechanism is adapted to secure the tape cutting unit on the tape roll.

BRIEF DESCRIPTION OF THE DRAWINGS

Illustrative embodiments of the disclosure will now be described by way of example, with reference to the accompanying drawings, in which:

FIG. 8 is a top view of an illustrative tape cutting device, secured on a roll of tape in exemplary application of the tape cutting device;

FIG. 9 is a front view of an illustrative tape cutting device, secured on a roll of tape in exemplary application of the tape cutting device;

FIG. 10 is an enlarged sectional view, taken along section line 10 in FIG. 9, of a portion of an illustrative tape cutting device, more particularly illustrating a retainer bead of an exemplary retainer mechanism seated in a bead seat in the tape cutting unit according to an exemplary technique for securing the tape cutting device on a tape roll;

FIG. 11 is a top view of an exemplary tape segment cut from a roll of tape in implementation of an illustrative tape cutting device;

FIG. 12 is a side view of an illustrative tape cutting device, secured on a tape roll (partially in section) in exemplary implementation of the device, more particularly illustrating tearing of a segment of tape from the tape roll;

DETAILED DESCRIPTION

Figure 1:
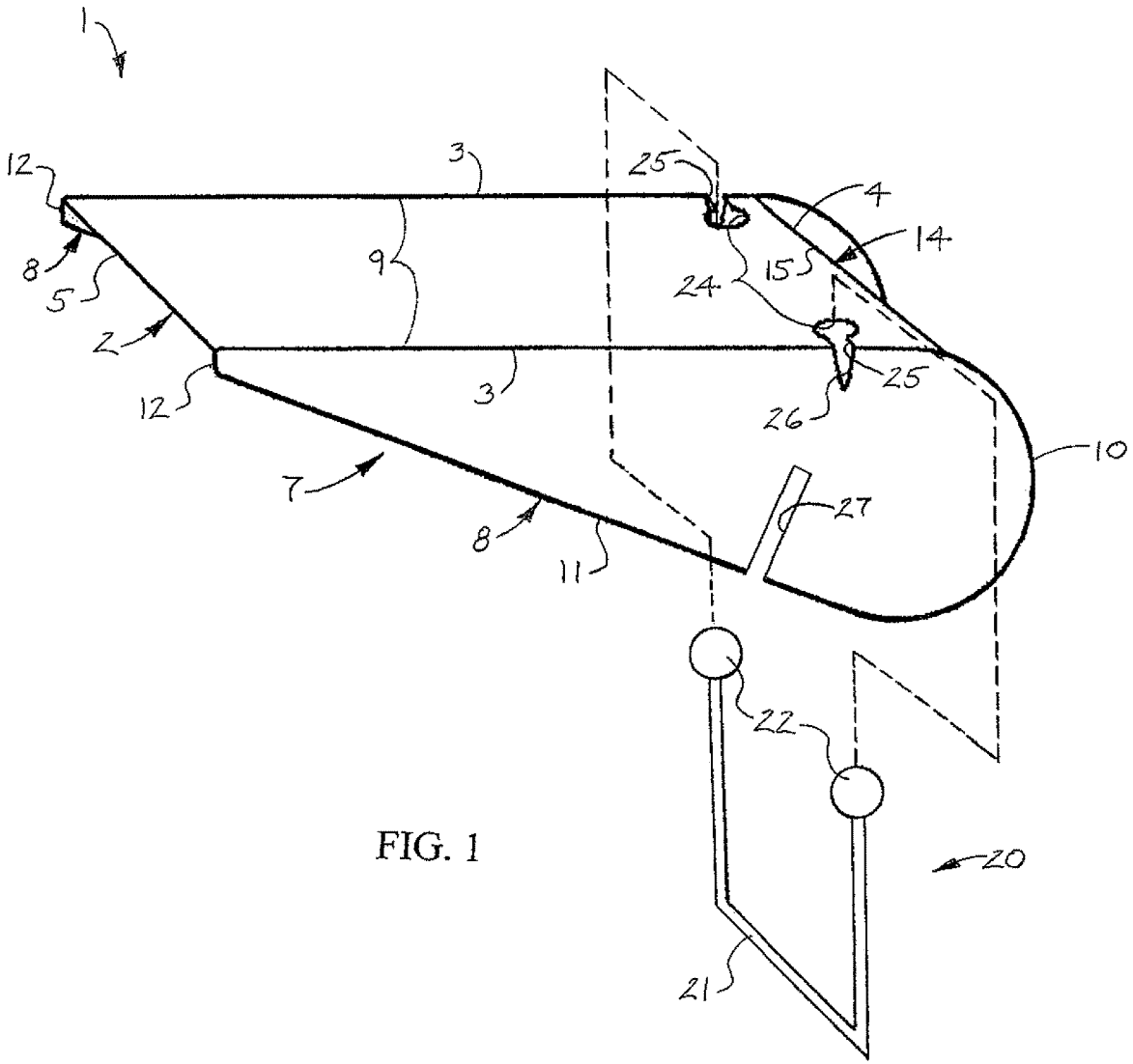
FIG. 1 is an exploded perspective view of an illustrative embodiment of the tape cutting device, with an exemplary tape cutting unit and an exemplary retainer mechanism which is suitable for securing the tape cutting unit on a roll of tape (not illustrated)
Figure 2:
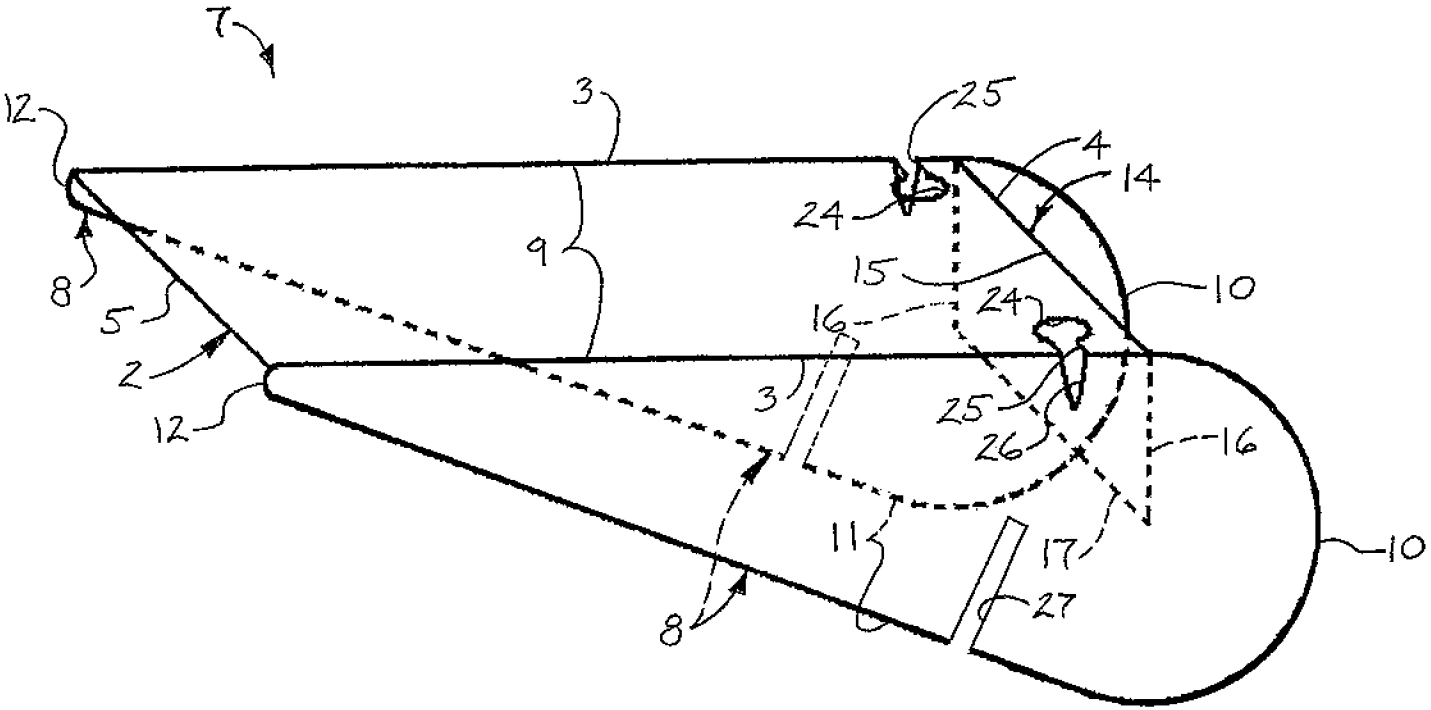
FIG. 2 is a perspective view of an exemplary tape cutting unit of a tape cutting device, with hidden components of the tape cutting unit illustrated in phantom lines.
Figure 3:
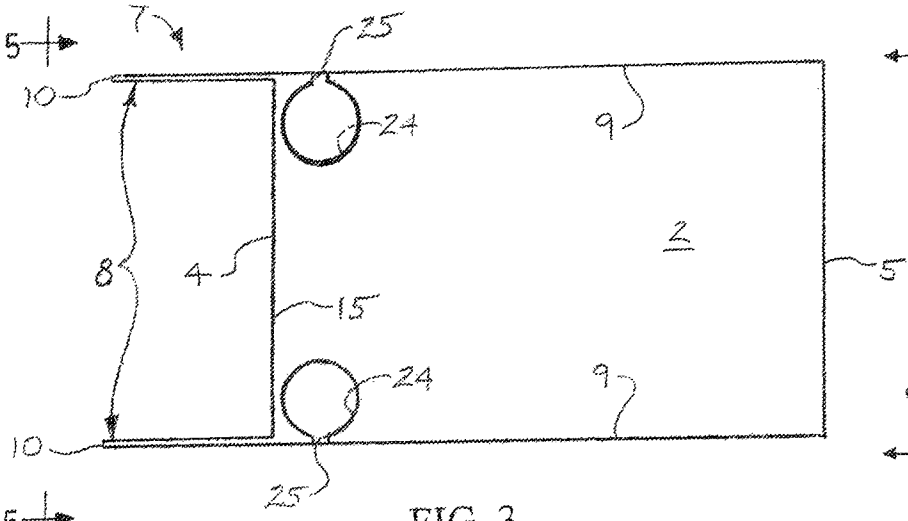
FIG. 3 is a top view of an exemplary tape cutting unit of a tape cutting device.
Figure 5:
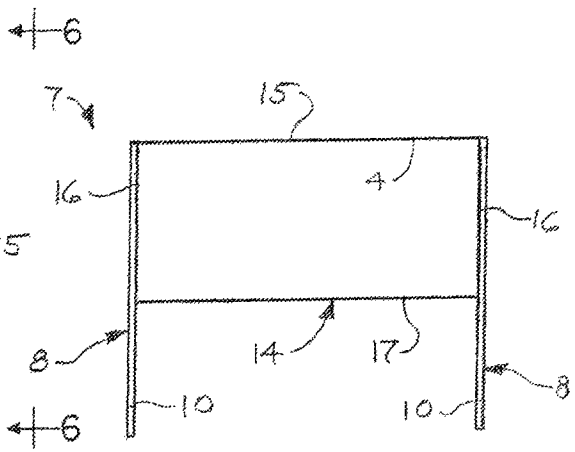
FIG. 5 is a front view, taken along section lines 5-5 in FIG. 3, of exemplary tape cutting unit.
Figure 4:
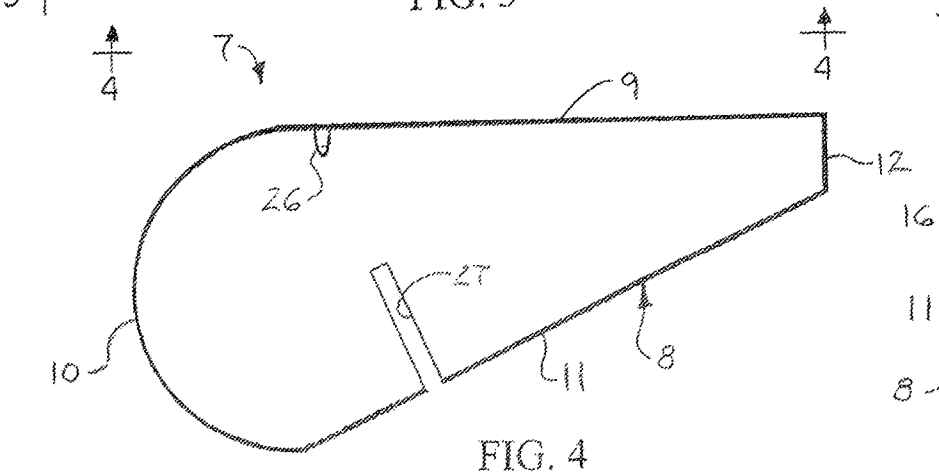
FIG. 4 is a side view, taken along side lines 4-4 in FIG. 3, of an exemplary tape cutting unit.
Figure 6:
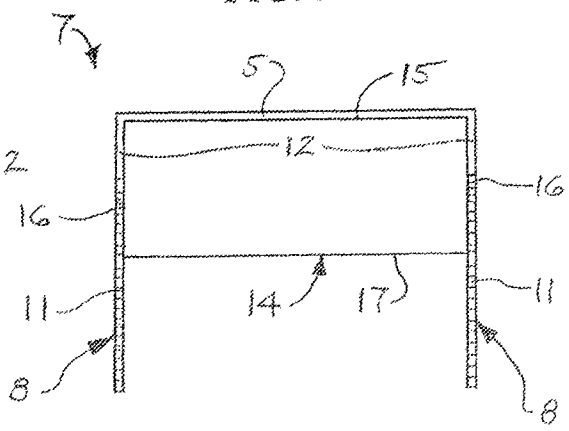
FIG. 6 is a rear view, taken along section lines 6-6 in FIG. 3, of an exemplary tape cutting unit.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "front" and "rear" as used herein are intended for descriptive purposes only and are not necessarily intended to be construed in a limiting sense.

Referring initially of FIGS. 1-16 of the drawings, an illustrative embodiment of the tape cutting device is generally indicated by reference numeral 1. As illustrated in FIGS. 8-16 and will be hereinafter described, the tape cutting device 1 is adapted to be secured on a tape roll 30 which may be conventional and typically has a spool 31 on which is wound a continuous length of adhesive tape 32. The adhesive tape 32 may be masking tape, duct tape, packaging tape or any other type of commercially-available adhesive tape which is wound on and dispensed from a spool 31 for any of a variety of purposes. The tape cutting device 1 can be used to cut tape segments 33 (FIG. 11) of consistently selected uniform lengths and/or straight edges 34 from the tape 32 wound on the spool 31.

As illustrated in FIGS. 1-7, the tape cutting device 1 includes a tape cutting unit 7 and a retainer mechanism 20 which secures the tape cutting unit 7 on the tape roll 30. The tape cutting unit 7 may include a device panel 2. The device panel 2 may be generally rectangular with a pair of spaced-apart, parallel side panel edges 3 and a blade support edge 4 and a tape roll engaging edge 5 extending between the side panel edges 3 in parallel spaced-apart relationship to each other.

A pair of spaced-apart tape roll guides 8 may extend from the respective side panel edges 3 of the device panel 2. The tape roll guides 8 may be disposed at a generally 90-degree angle with respect to the device panel 2 and in generally parallel, spaced-apart relationship to each other. Each tape roll guide 8 may have a straight panel attachment edge 9 which is joined to or continuous with the corresponding side panel edge 3 of the device panel 2. Each tape roll guide 8 may have a blade end guide edge 10 which may be generally semicircular and is continuous with the panel attachment edge 4 and protrudes beyond the blade support edge 4 of the device panel 2. A return guide edge 11 may be straight and is continuous with the blade end guide edge 10. A terminal guide edge 12 may be continuous with the return guide edge 11 and the panel attachment edge 9 at the tape roll engaging edge 5 of the device panel 2.

A tape cutting blade 14 extends from the blade support edge 4 of the device panel 2 and is disposed between the spaced-apart tape roll guides 8. The tape cutting blade 14 may be disposed at a generally 90-degree angle with respect to the device panel 2 and with respect to each of the tape roll guides 8. As particularly illustrated in FIGS. 2 and 5, the tape cutting blade 14 may be generally rectangular with a blade attachment edge 15 which is joined to or continuous with the blade support edge 4 of the device panel 2; a pair of spaced-apart, parallel blade side edges 16 which extend from the blade attachment edge 15 and may be engaged by the respective tape roll guides 8; and a tape cutting edge 17 which extends between the blade side edges 16 in spaced-apart, parallel relationship to the blade attachment edge 15. The tape cutting edge 17 may be tapered in cross-section.

Figure 7:
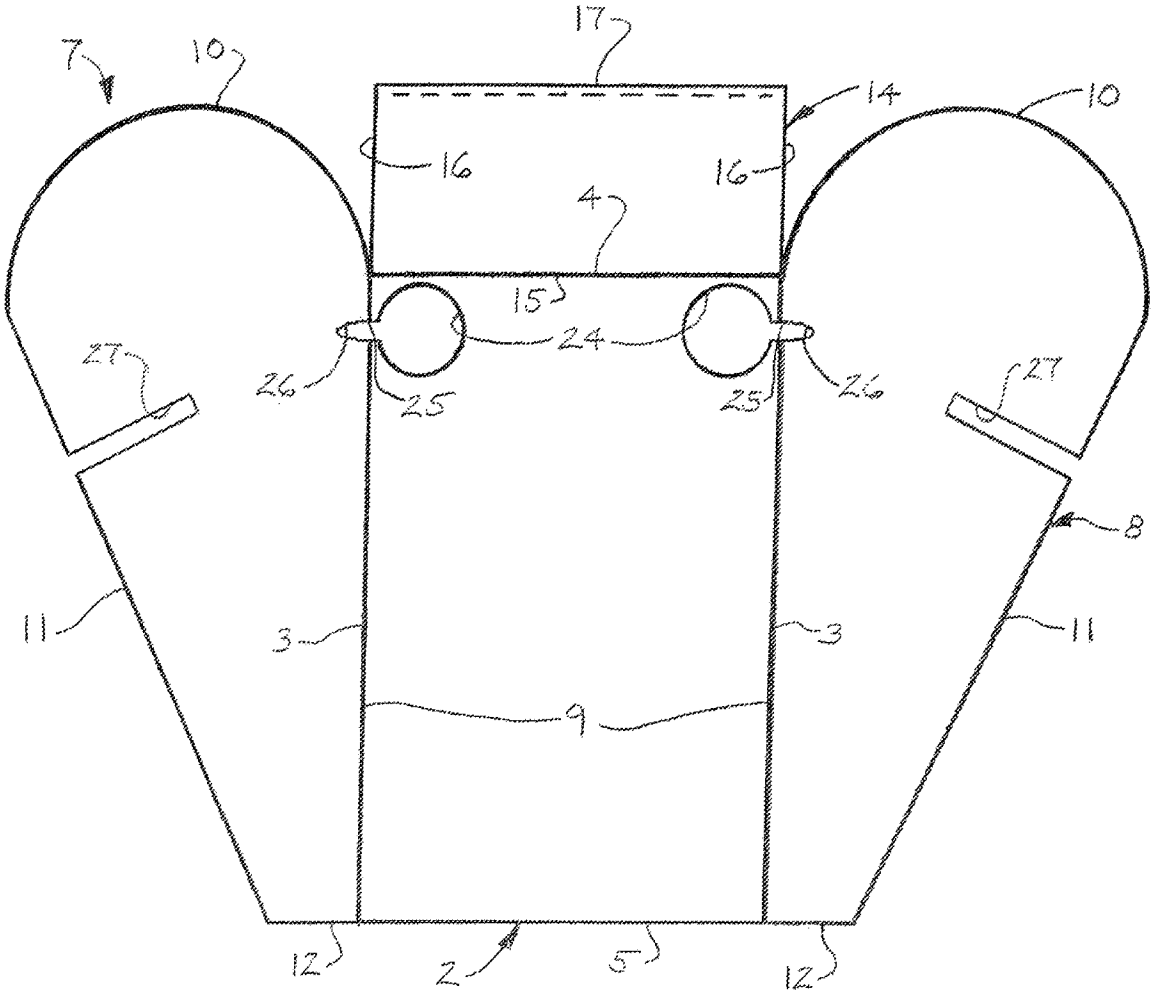
FIG. 7 is a top view of an exemplary unfolded tape cutting unit according to an illustrative embodiment of the tape cutting device.

The tape cutting unit 7 may be any material which is consistent with the functional requirements of the tape cutting device 1. Non-limiting examples of materials which are suitable for the purpose include aluminum, steel, high-grade plastics, composite materials and combinations thereof. The tape cutting unit 7 can be fabricated using any of a variety of fabrication techniques known by those skilled in the art including but not limited to casting, molding, machining, welding and soldering. As illustrated in FIG. 7, in some methods of fabrication, the device panel 2, the tape roll guides 8 and the tape cutting blade 14 of the tape cutting unit 7 may be cut or stamped flat from a sheet (not illustrated) of material such as aluminum, steel or composite material, for example and without limitation. The tape roll guides 8 may be folded along the respective side panel edges 3 and the tape cutting blade 14 may be folded along the blade support edge 4 of the device panel 2 to shape the tape cutting unit 7. In other methods of fabrication, the tape roll guides 8 and the tape cutting blade 14 may be fabricated separately and attached to the device panel 2 according to the knowledge of those skilled in the art.

Figure 13:
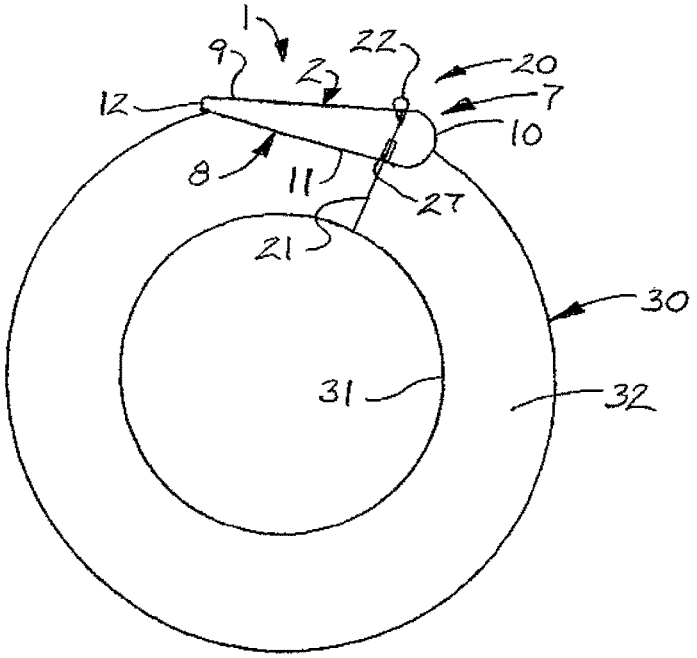
FIG. 13 is a side view of an illustrative tape cutting device, secured on a tape roll in exemplary implementation of the device.

As further illustrated in FIG. 1, the tape cutting device 1 may include a retainer mechanism 20 which secures the tape cutting unit 7 on the tape roll 30 (FIG. 13). In some embodiments, the retainer mechanism 20 may include an elongated, flexible and elastic retainer cord 21. Retainer members 22 may terminate the opposite ends of the retainer cord 21. The retainer members 22 may be beads, knots, washers or the like. A pair of spaced-apart retainer seats 24 may be provided in the device panel 2 of the tape cutting unit 7. A cord slit 25 communicates with and extends from each retainer seat 24 to the side panel edge 3 of the device panel 2. A cord notch 26 in the tape roll guide 8 communicates with the cord slit 25. A cord accommodation notch 27 may extend from the return guide edge 11 of each tape roll guide 8, at an angle toward the retainer seat 24. Accordingly, as illustrated in FIGS. 8-10, the retainer members 22 are seated and retained in the respective retainer seats 24 in the device panel 2. The retainer cord 21 extends through the cord notches 26 in the respective tape roll guides 8 and adjacent to the respective cord accommodation slots 27 through the spool 31 of the tape roll 30, engaging the inner surface of the spool 31. Thus, the retainer cord 21 of the retainer mechanism 20 maintains a secure and tight fit of the tape cutting unit 7 on the tape roll 30 throughout use of the tape cutting device 1, as will be hereinafter described.

As illustrated in FIGS. 8-16, in exemplary application of the tape cutting device 1, the tape cutting unit 7 is secured on the tape roll 30 by initially placing the spaced-apart tape roll guides 8 on opposite sides of the tape roll 30. The tape roll engaging edge 5 of the device panel 2 engages the outermost layer of the tape 32 which is wound on the spool 31 of the tape roll 30. The tape cutting edge 17 on the tape cutting blade 14 engages the outermost layer of tape 32 against the underlying layers of tape 32 on the tape roll 30. The retainer mechanism 20 secures the tape ending unit 7 on the tape roll 30 by extension of the retainer cord 21 through the cord notches 26 and the spool 31 and seating of the retainer member 22 in the respective retainer seats 24 in the device panel 2.

The tape cutting unit 7 is slid along the tape roll 30 until the tape cutting blade 14 is located at a selected distance from the free end (not illustrated) of the tape 32, which distance corresponds to the desired length of the tape segment 33 to be cut from the tape 32. Manual pressure may be applied to the device panel 3 such that the tape cutting edge 17 of the tape cutting blade 14 crimps the tape 32. The free end of the tape 32 is next located and grasped, and the tape segment 33 which is to be removed is peeled from the underlying portion of the tape 32 wound on the spool 31. As it is removed from the underlying wound tape 32, the tape segment 33 is pulled against and across the tape cutting edge 17 of the tape cutting blade 14 such that the blade attachment edge 15 severs the tape segment 33 from the tape 32. As illustrated in FIG. 11, it will be appreciated by those skilled in the art that the blade attachment edge 15 of the tape cutting blade 14 cuts a straight edge 34 in the tape segment 33 as well as multiple tape segments 33 of selected and uniform or consistent length.

Figure 14:
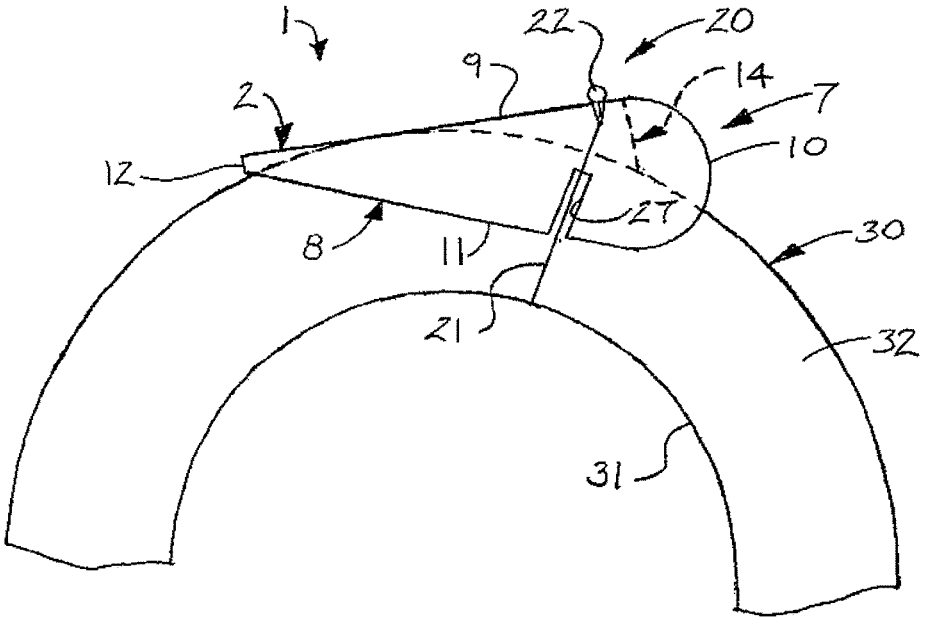
FIGS. 14-16 are side views of an illustrative tape cutting device secured on a tape roll (partially in section) in exemplary implementation of the deuce, with the retainer mechanism maintaining a tight fit of the device on the tape roll of decreasing diameter as the tape segments are progressively dispensed from the roll.
Figure 15:
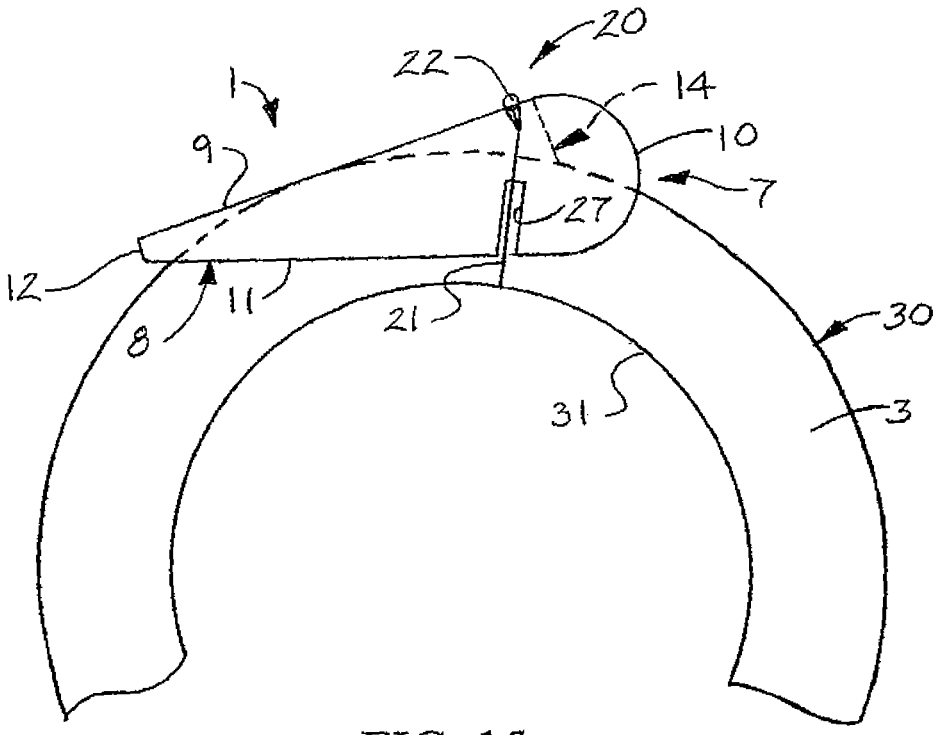
Figure 16:
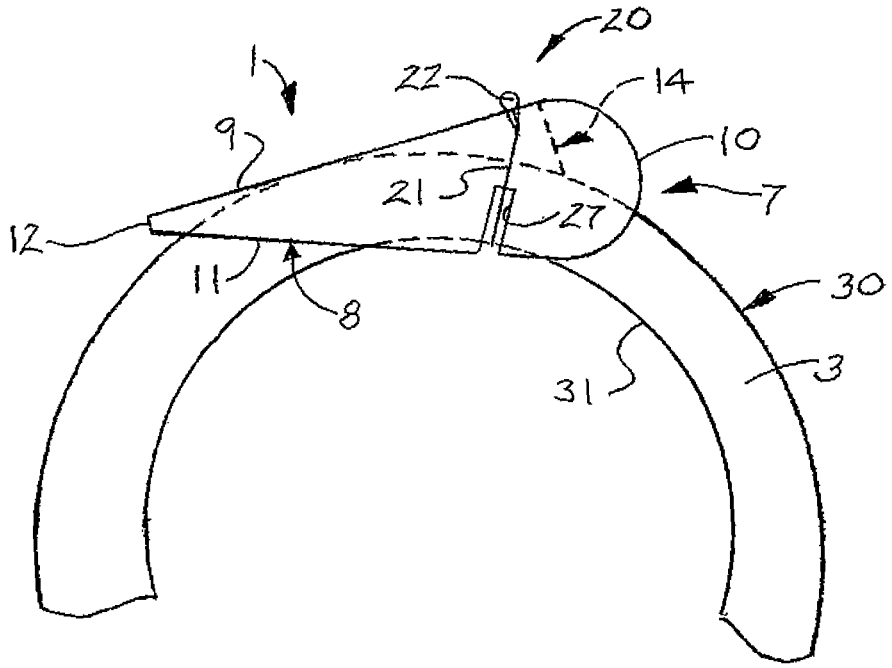

As the tape segments 33 are cut and dispensed from the tape roll 30, the tape cutting device 1 is pushed or "rides" along the tape roll 30 to position the tape cutting edge 17 of the tape cutting blade 14 at the selected positions along the tape 32 for cutting and dispensing of the tape segments 33 of selected length. Throughout use of the tape cutting device 1, the elastic retainer cord 21 of the retainer mechanism 20 is constantly in a contracted state and thus, continually maintains a secure and snug fit of the tape cutting unit 7 against the tape roll 30. Therefore, as the diameter of the tape roll 30 progressively decreases as a result of the tape 32 being gradually dispensed from the spool as illustrated in FIGS. 14-16, the retainer cord 21 contracts and continues to snugly secure the tape cutting unit 7 on the tape roll 30 and prevents loosening of the tape cutting unit 7. As illustrated in FIG. 16, when the diameter of the tape roll 30 decreases to the point at which the spool 31 of the tape roll 30 recedes beyond the return guide edge 11 of each tape roll guide the cord accommodation slots 27 accommodate the retainer cord 21 such that the retainer cord 21 continues to engage the inner surface of the spool 31. When all of the tape 32 has been dispensed from the spool 31, the tape cutting unit 7 can be removed from the spool 31 by disengaging the retainer members 22 from the respective retainer seats 24 in the device panel 2 and removing the retainer cord 21. The tape cutting device 1 can be subsequently used in a similar manner on a fresh tape roll 30.

Figure 17:
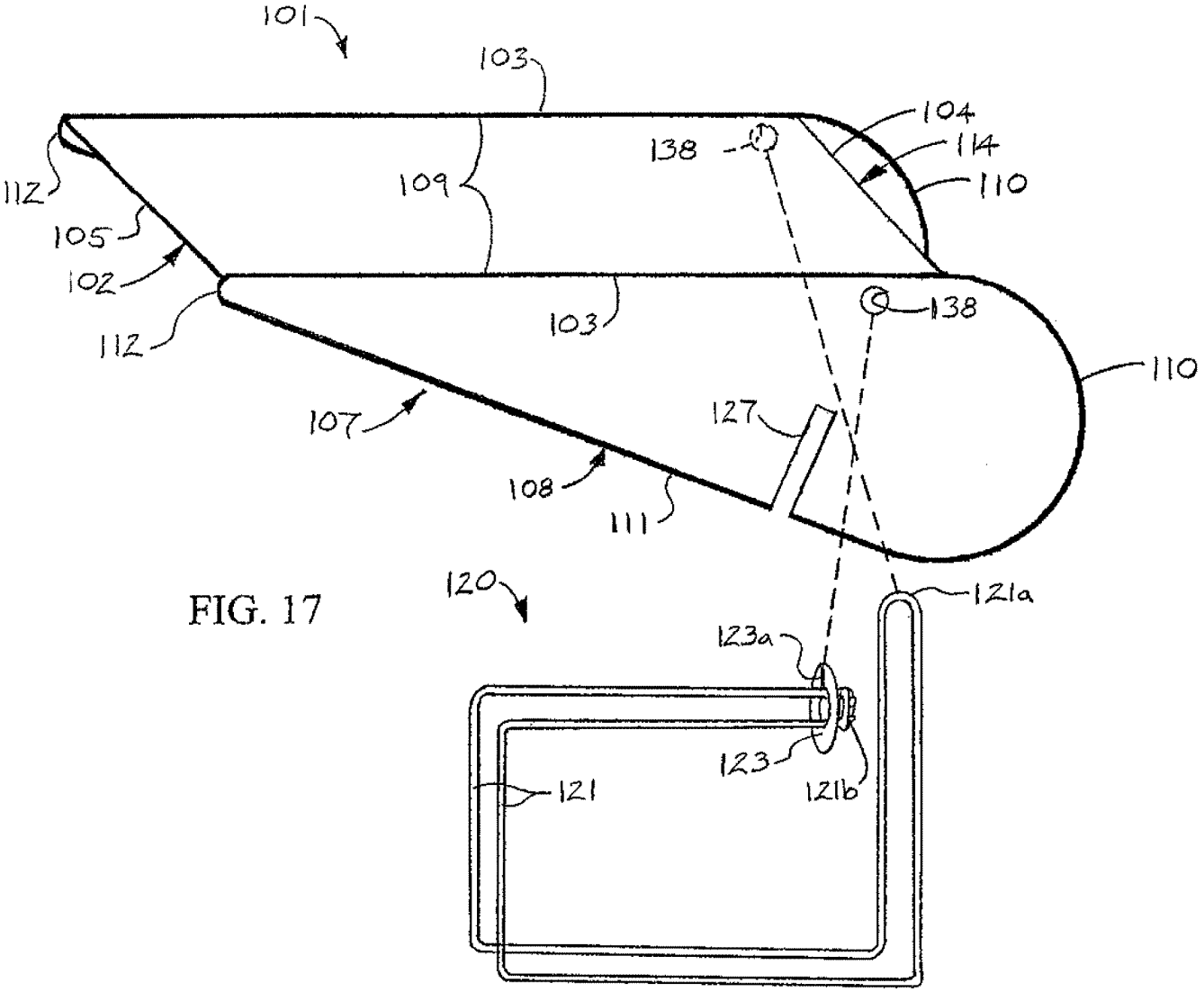
FIG. 17 is an exploded perspective view of an illustrative tape cutting device, with an alternative exemplary retainer mechanism which is suitable for securing the tape cutting unit of the tape cutting device on a roll of tape.
Figure 17A:
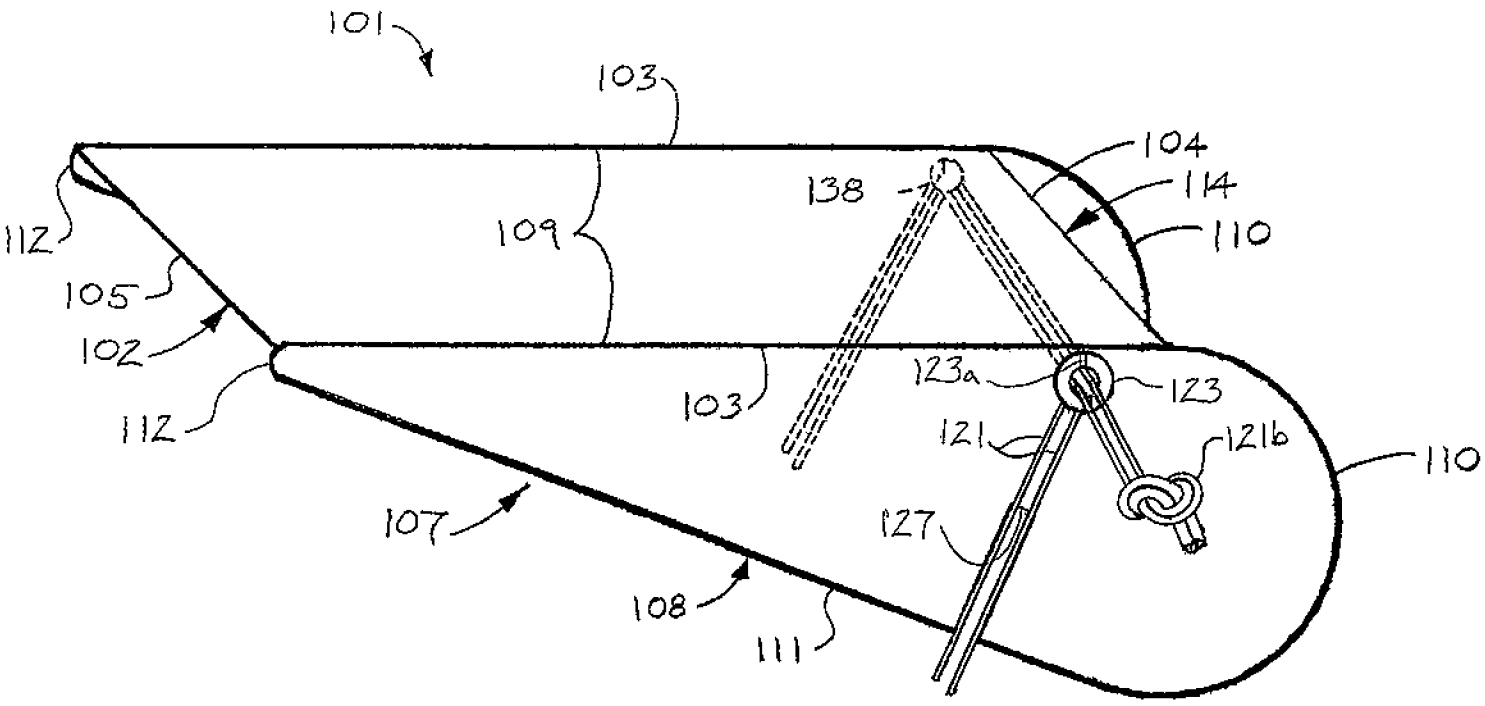
FIG. 17A is a perspective view of an illustrative tape cutting device with the exemplary retainer mechanism illustrated in FIG. 17.

Referring next to FIGS. 17 and 17A of the drawings, an alternative illustrative embodiment of the tape cutting device is generally indicated by reference numeral 101. In the tape cutting device 101 of FIG. 17, elements which are analogous to the respective elements of the tape cutting device 1 that was heretofore described with respect to FIGS. 1-16 are designated by the same numeral in the 101-199 series. An exemplary retainer mechanism 120 may include an elastic retainer cord 121 having a cord loop 121*a*. A cord knot 121*b* may be tied in the ends of the retainer cord 121 and retains a retainer washer 123 on the retainer cord 121. The washer 123 may have a washer slot 123*a*. A pair of spaced-apart cord openings 138 may extend through the respective tape roll guides 108. Accordingly, the retainer cord 121 is extended through the cord openings 138 and through the spool 31 (FIG. 13) of the tape roll 30. The cord loop 121*a* receives and engage the retainer washer 123, which retains the retainer cord 121 around the tape roll 30 such that the tape cutting unit 7 is retained on the spool 31. The retainer cord 121 may be pulled through the retainer washer 123 by grasping the cord knot 121*b* to tighten the retainer cord 121 as the tape roll 30 decreases in diameter during the course of use. Application of the tape cutting device 101 may be as was heretofore described with respect to the tape cutting device 1 in FIGS. 1-16.

Figure 18:
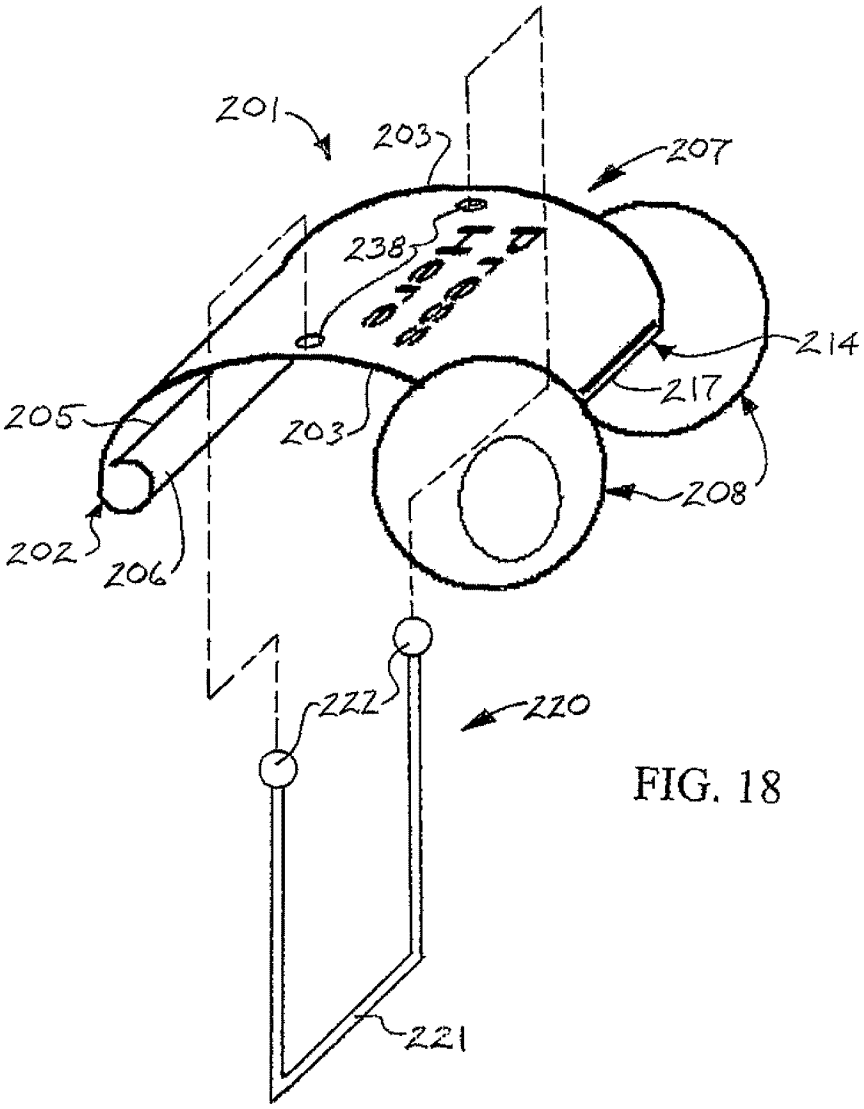
FIG. 18 is an exploded perspective view of an alternative illustrative embodiment of the tape cutting device.

Referring next to FIG. 18 of the drawings, another alternative illustrative embodiment of the tape cubing device is generally indicated by reference numeral 201. In the tape cutting device 201 of FIG. 18, elements which are analogous to the respective elements of the structure 1 that was heretofore described with respect to FIGS. 1-16 are designated by the same numeral in the 201-299 series. The device panel 202 of the tape cutting unit 207 may be generally curved with a tape roll engaging roll 206 at the tape wall engaging edge 205. A pair of spaced-apart circular tape roll guides 208, each of which may be circular, may be provided on the respective side panel edges 203 of the device panel 202. A tape cutting blade 214 has a tape cutting edge 217 which corresponds to a front edge of the device panel 202 and extends between the tape roll guides 208.

A retainer mechanism 220 is adapted to secure the tape cutting unit 207 on a tape roll 30 (FIGS. 8-16). In some embodiments, the retainer mechanism 220 may include an elastic retainer cord 221 terminated by a pair of retainer members 222. A pair of spaced-apart cord openings 238 may be provided in the device panel 202. Accordingly, the retainer members 222 are seated and retained in the respective cord openings 238 in the device panel 202. The retainer cord 221 extends through the cord openings 238 in the device panel 202 and through the spool 31 of the tape roll 30, engaging the inner surface of the spool 31. In other embodiments, the retainer mechanism 220 may have alternative designs which are suitable for the purpose of securing the tape cutting unit 207 on the tape roll 30. The tape roll engaging roll 206 of the device panel 202 engages the tape roll 30, and the tape roll guides 208 are positioned on opposite sides of the tape roll 30. Application of the tape cutting device 101 may be as was heretofore described, with respect to the tape cutting device 1 in FIGS. 8-16. The retainer cord 221 of the retainer mechanism 220 maintains a secure and tight fit of the tape cutting unit 207 on the tape roll 30 throughout use of the tape cutting device 201, as was heretofore described with respect to the tape cutting device 1.

Figure 19:
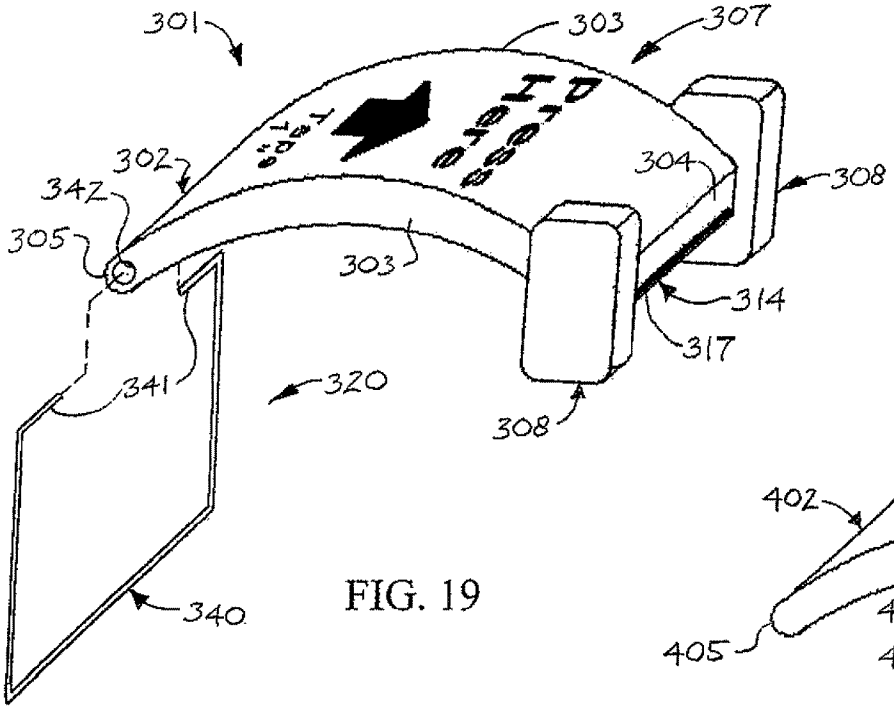
FIG. 19 is an exploded perspective view of another illustrative embodiment of the tape cutting device.
Figure 22:
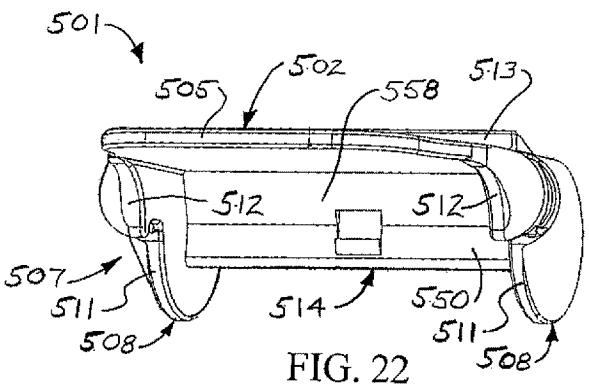
FIG. 22 is a rear perspective view of the tape cutting unit illustrated in FIG. 21.
Figure 21:
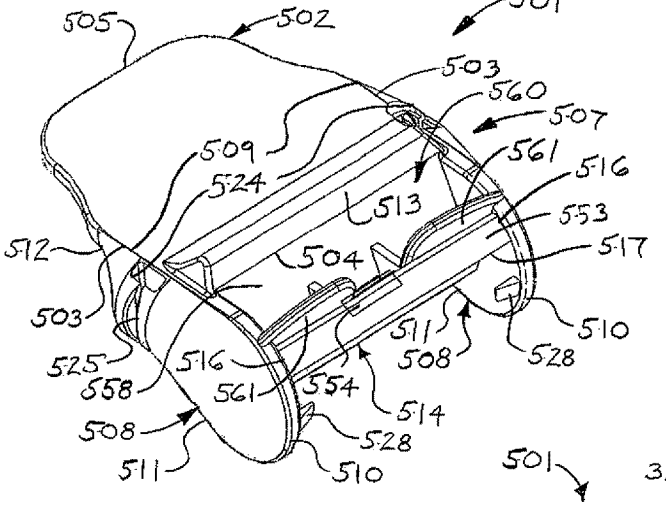
FIG. 21 is a front perspective view of a typical tape cutting unit of another alternative illustrative embodiment of the tape cutting device.
Figure 23:
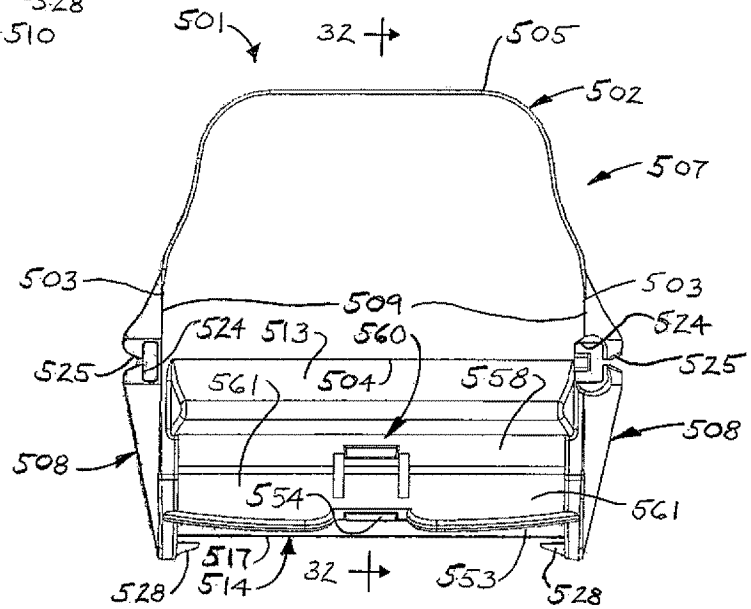
FIG. 23 is a top view of the tape cutting unit illustrated in FIG. 21.

Referring next to FIG. 19 of the drawings, another alternative illustrative embodiment of the tape cutting device is generally indicated by reference numeral 301. In the tape cutting device 301 of FIG. 19, elements which are analogous to the respective elements of the tape cutting device 1 that was heretofore described with respect to FIGS. 1-16 are designated by the same numeral in the 301-399 series. The device panel 302 of the tape cutting device 301 may be generally curved. A pair of spaced-apart block-shaped tape roll guides 308 may be provided on the respective side panel edges 303 of the device panel 302. A tape cutting blade 314 has a tape cutting edge 317 which corresponds to a front edge of the device panel 302 and extends between the tape roll guides 308.

An exemplary retainer mechanism 320 of the tape cutting device 301 may include a retainer wire 340 having a pair of spaced-apart and inwardly-facing insertion ends 341. A pair of retainer wire openings 342 may be provided in the respective side panel edges 303 of the device panel 302. The retainer wire openings 342 are adapted to receive the respective insertion ends 341 of the retainer wire 340. Accordingly, the tape cutting unit 307 is secured on a tape roll 30 (FIGS. 8-16) by initially extending the retainer wire 340 through the spool 31 of the tape roll 30 and then inserting the insertion ends 341 of the retainer wire 340 into the respective retainer wire openings 342. The tape roll engaging edge 305 of the device panel 302 engages the tape roll 30, and the tape roll guides 308 are positioned on opposite sides of the tape roll 30. The retainer wire 340 of the retainer mechanism 320 maintains a secure and tight fit of the tape cutting unit 307 on the tape roll 30 throughout use of the tape cutting device 301, as was heretofore described with respect to the tape cutting device 1. In other embodiments, the retainer mechanism 320 may have alternative designs which are suitable for the purpose of securing the tape cutting unit 307 on the tape roll 30.

Figure 20:
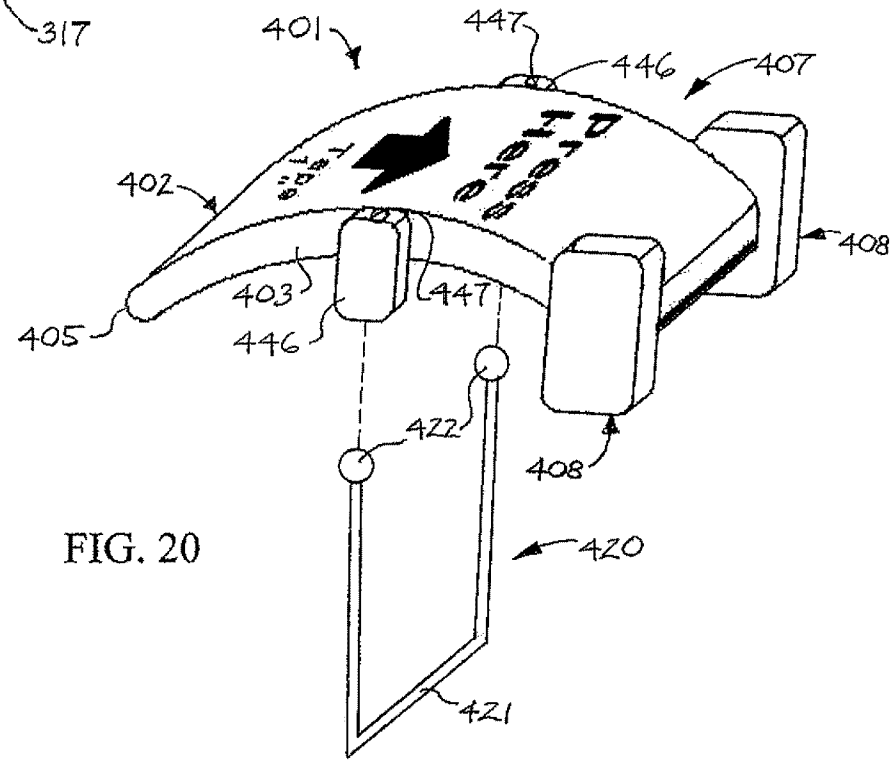
FIG. 20 is an exploded perspective view of still another illustrative embodiment of the tape cutting device.

Referring next to FIG. 20 of the drawings, another alternative illustrative embodiment of the tape cutting device is generally indicated by reference numeral 401. In the tape cutting device 401 of FIG. 20, elements which are analogous to the respective elements of the tape cutting device 301 that was heretofore described with respect to FIG. 19 are designated by the same numeral in the 401-499 series. An exemplary retainer mechanism 420 which secures the tape cutting unit 407 to a tape roll 30 may include a pair of spaced-apart retainer mount members 446. A cord opening 447 may extend through each retainer mount member 446. A retainer cord 421 which terminates in a pair of retainer members 422 extends through and is retained in each cord opening 447 as the retainer members 422 seat on the respective retainer mount members 446. The retainer cord 421 extends through the spool 31 of the tape roll 30, engaging the inner surface of the spool 31. In other embodiments, the retainer mechanism 420 may have alternative designs which are suitable for the purpose of securing the tape cutting unit 407 on the tape roll 30. The tape roll engaging edge 405 of the device panel 402 engages the tape roll 30, and the tape roll guides 408 are positioned on opposite sides of the tape roll 30. Application of the tape cutting device 401 may be as was heretofore described with respect to the tape cutting device in FIGS. 8-16. The retainer cord 421 of the retainer mechanism 420 maintains a secure and tight fit of the tape cutting unit 407 on the tape roll 30 throughout use of the tape cutting device 401, as was heretofore described with respect to the tape cutting device 1.

Referring next to FIGS. 21-36D of the drawings, another alternative illustrative embodiment of the tape cutting device is generally indicated by reference numeral 501. In the tape cutting device 501 of FIGS. 21-36D, elements which are analogous to the respective elements of the tape cutting device 1 that was heretofore described with respect to FIGS. 1-16 are designated by the same numerals in the 501-599 series. Unless otherwise noted, the same descriptions which were heretofore applied to the various embodiments of the tape cutting device in FIGS. 1-20 may also apply to the tape cutting device 501.

A thumb flange 513 may protrude from the device panel 502 along the blade support edge 504 of the device panel 502. A rear blade mount panel 558 may extend along and angle from the blade support edge 504 between the tape roll guides 508. A front blade mount panel 559 may extend along and angle from the rear blade mount panel 558 between the tape roll guides 508. At least one finger guard 561 may protrude from the front blade mount panel 559. A panel gap 560, typically having a V-shape or U-shape in cross-section (FIG. 32), may be formed by and between the rear blade mount panel 558 and the front blade mount panel 559.

Figure 25:
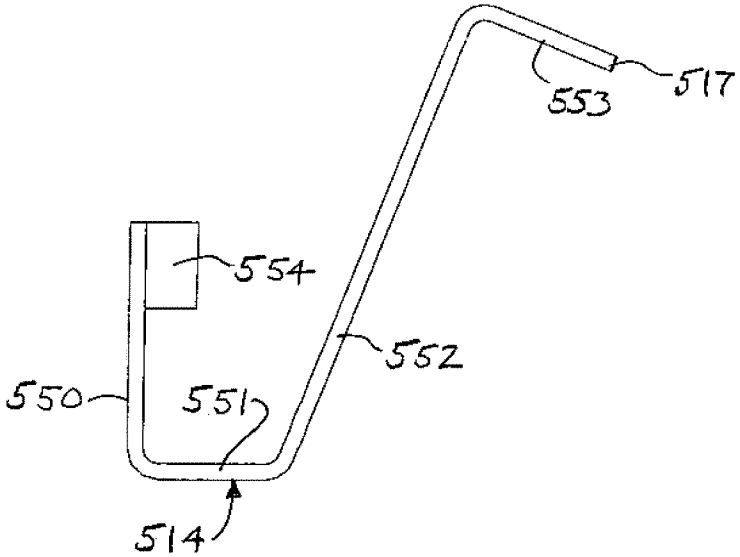
FIG. 25 is a side view of the tape cutting blade illustrated in FIG. 24.
Figure 24:
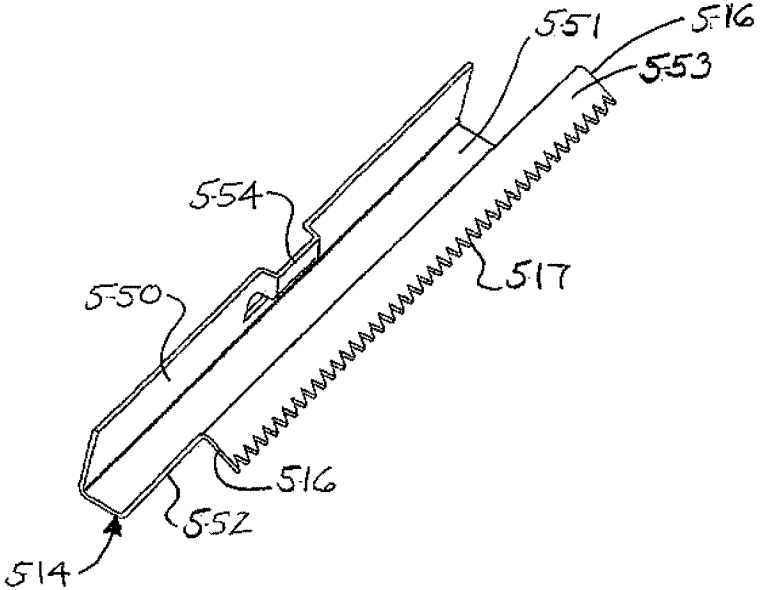
FIG. 24 is a front perspective view of a typical tape cutting blade of the tape cutting unit illustrated in FIG. 21.
Figure 26:
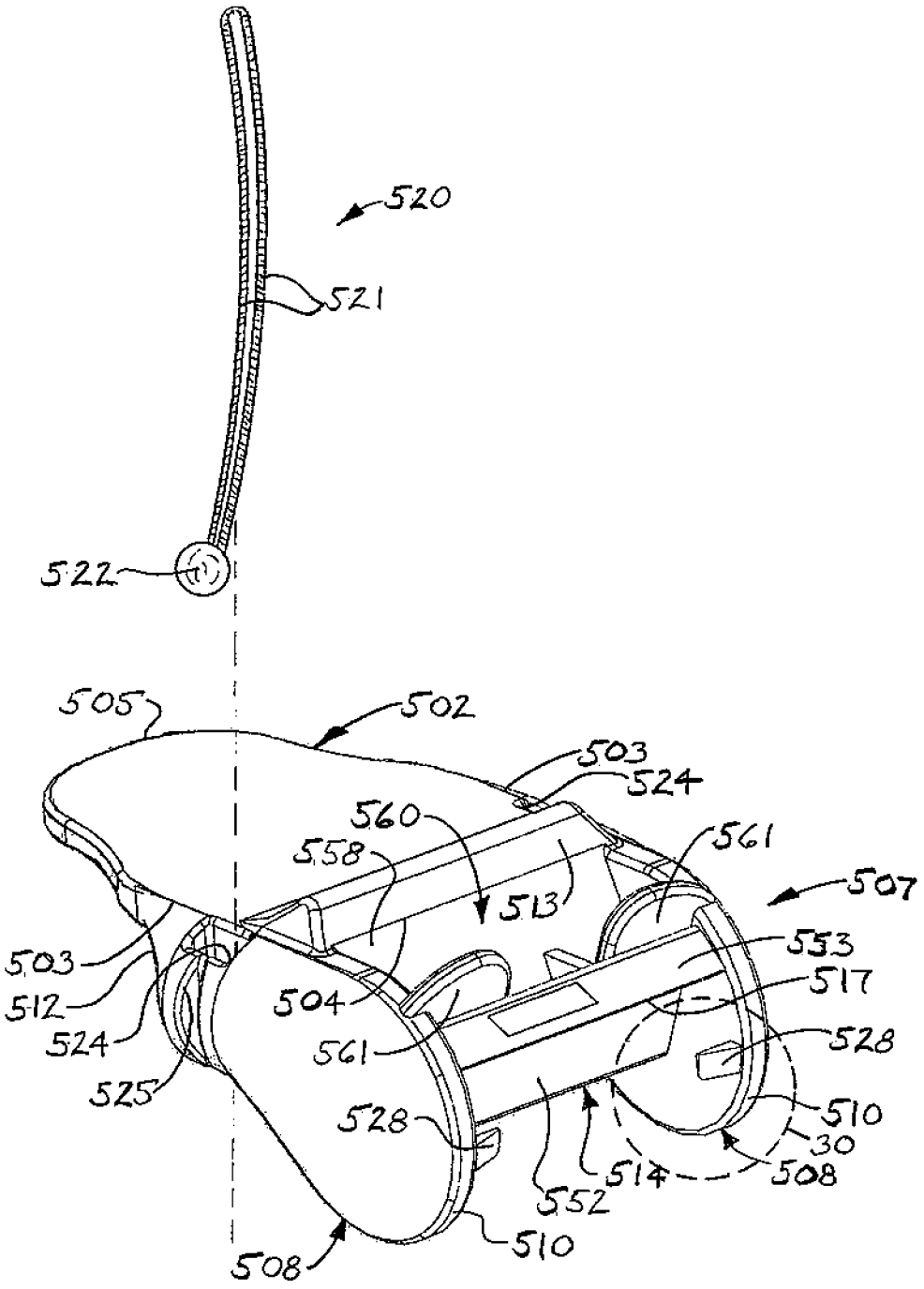
FIG. 26 is an exploded perspective view of the tape cutting unit illustrated in FIG. 21 with a typical retainer mechanism according to the illustrative tape cutting device.

The tape cutting blade 514 may be mounted on the rear blade mount panel 558 and the front blade mount panel 559. As illustrated in FIGS. 24 and 25, in some embodiments, the tape cutting blade 514 may include a rear blade mount portion 550 typically having a blade mount tab 554. A spanning blade portion 551 may extend from the rear blade mount portion 550. A from blade mount portion 552 may extend from the spanning blade portion 551. A tape cutting portion 553, having a tape cut ting edge 517, may extend from the front blade mount portion 552. In some embodiments, the tape cutting edge 517 may be serrated. In other embodiments, the tape cutting edge 517 may be non-serrated. In some embodiments, the tape cutting portion 553 may be oriented at an angle, of about 70-100 degrees with respect to the front blade mount portion 552 of the tape cutting blade 514.

Figure 32:
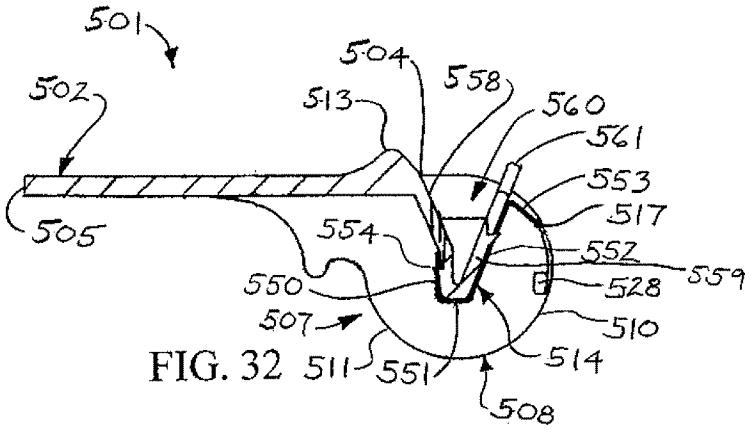
FIG. 32 is a longitudinal sectional view, taken along section lines 32-32 in FIG. 23.

As illustrated in FIG. 32, the tape cutting blade 514 may be mounted to the tape cutting unit 507 by snap attachment of the rear blade mount portion 550 to the tear blade mount panel 558 typically at the blade mount tab 554 and by similar attachment of the front blade mount portion 552 to the front blade mount panel 559. The spanning blade portion 551 of the tape cutting blade 514 may extend beneath the junction between the rear blade mount panel 558 and the front blade mount panel 559. The tape cutting portion 553 of the tape cutting blade 514 extends typically at an acute angle to the front blade mount portion 552 and may span the tape roll guides 508.

Figure 28:
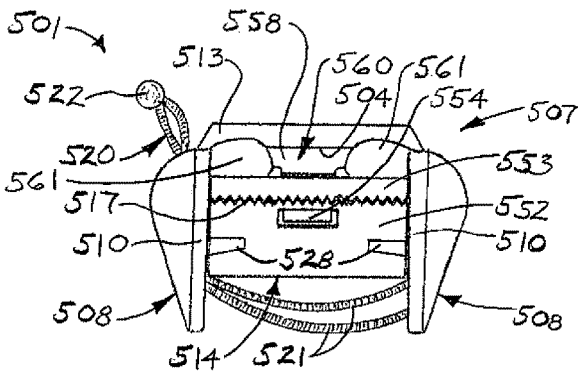
FIG. 28 is a front view of the illustrative tape cutting device illustrated in FIG. 27.
Figure 27:
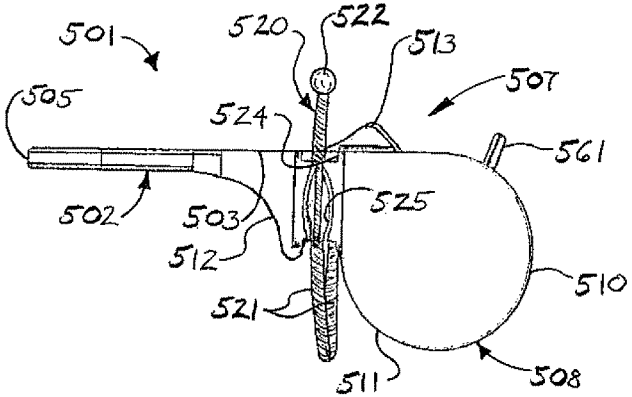
FIG. 27 is a left side view of the illustrative tape cutting device illustrated in FIG. 26, with the retainer mechanism deployed in a fastened position on the tape cutting unit.
Figure 29:
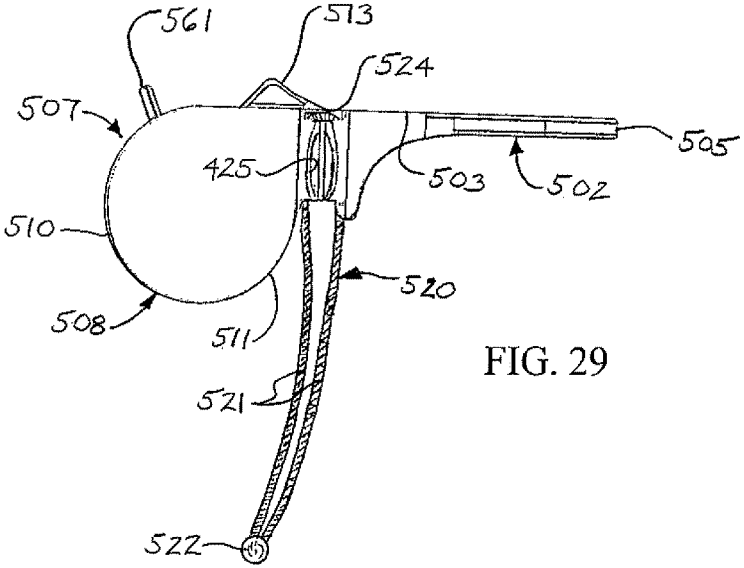
FIG. 29 is a right side view of the illustrative tape cutting device illustrated in FIG. 27, with the retainer mechanism deployed in an unfastened position on the tape cutting unit.
Figure 31:
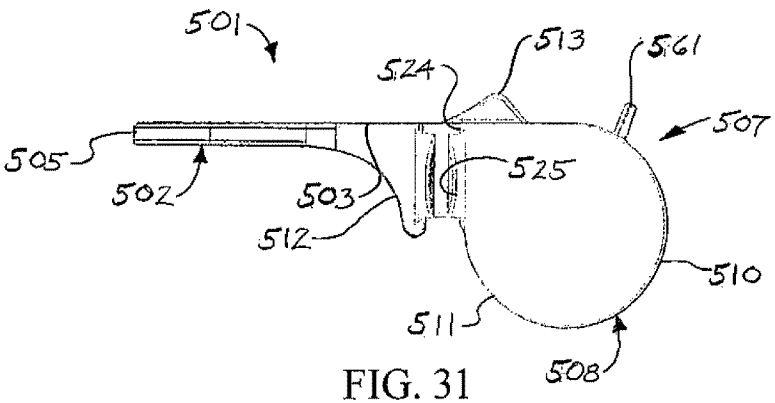
FIG. 31 is a right side view of the tape cutting unit of the illustrative tape cutting device illustrated in FIG. 27, with the retainer mechanism removed from the tape cutting unit.
Figure 33:
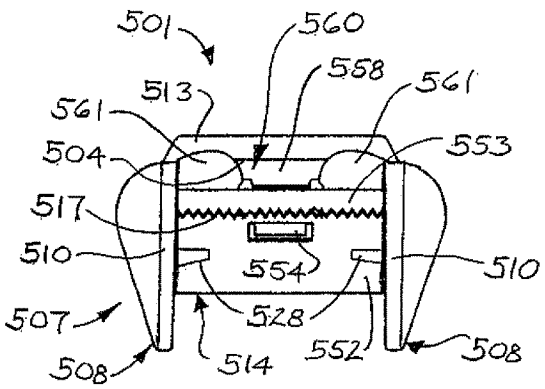
FIG. 33 is a front view of the tape cutting unit.
Figure 30:
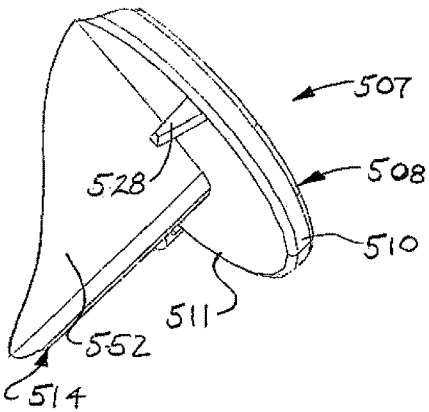
FIG. 30 is an enlarged sectional view, taken along section line 30 in FIG. 26.

In some embodiments, a pair of spaced-apart tape bending tabs 528 may extend toward each other from the inner surfaces of the respective tape roll guides 508. As illustrated in FIG. 28, the tape bending tabs 528 may be disposed beneath and in spaced-apart relationship to the tape cutting edge 517 of the tape cutting blade 514. The purpose of the tape bending tabs 528 will be hereinafter described.

As illustrated in FIGS. 26-29, the retainer mechanism 520 of the tape cutting device 501 may include at least one elastic retainer cord 521. At least one retainer member 522 may terminate the retainer cord 521. In some embodiments, the retainer member 522 may include a spherical bead. The retainer cord 521 may include a loop the ends of which are embedded in or attached to the retainer member 522 according to the knowledge of those skilled in the art.

Figure 34:
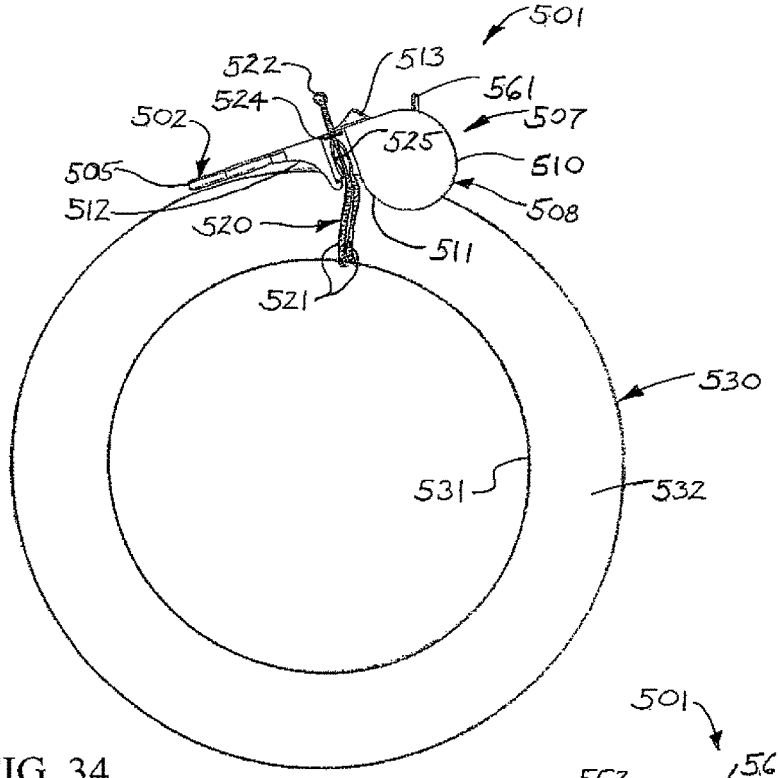
FIG. 34 is a side view of the illustrative tape cutting device of FIG. 27, secured on a tape roll in exemplary implementation of the device.
Figure 36A:
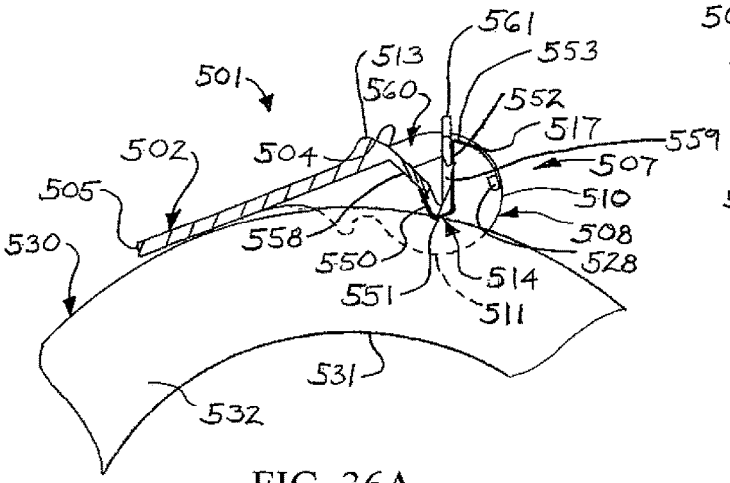
FIGS. 36A-36D are side views of the illustrative tape cutting device of FIG. 27 secured on the tape roll, more particularly illustrating a typical tape cutting sequence in exemplary application of the tape cutting device.
Figure 35:
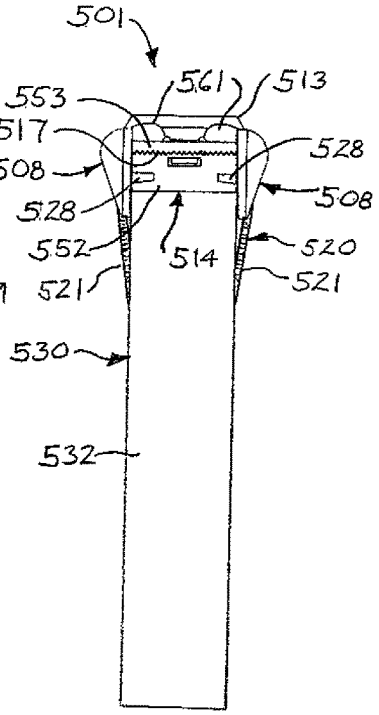
FIG. 35 is a front view of the illustrative tape cutting device of FIG. 27, secured on the tape roll in exemplary application of the tape cutting device.

As illustrated in FIGS. 34-36D, application of the tape cutting device 501 may be as was heretofore described with respect to the tape cutting device 1 in FIGS. 8-16. Accordingly, the tape cutting unit 507 is secured on the tape roll 530 by initially placing the spaced-apart tape roll guides 508 on opposite sides of the tape roll 530 with the tape roll engaging edge 505 of the device panel 502 engaging the outermost layer of the tape 532 wound on the spool 531 of the tape roll 530. As illustrated in FIG. 36A, the tape cutting edge 517 on the tape cutting blade 514 is initially disposed in spaced-apart relationship to the outermost layer of tape 532 on the tape roll 530. As illustrated in FIGS. 34 and 35, the retainer mechanism 520 secures the tape cutting unit 507 on the tape roll 530 by insertion of the retainer cord 521 through the retainer seats 524 and respective registering cord slits 525. In some applications, the retainer member 522 may be seated in the retainer seat 524 on one side of the device panel 502.

Figure 36B:
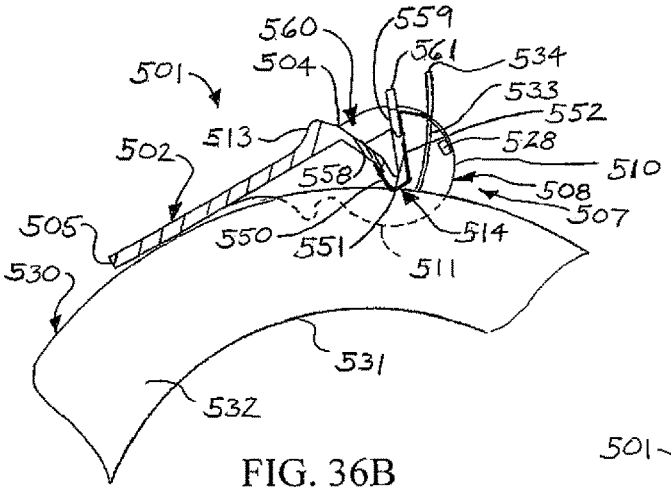
Figure 36C:
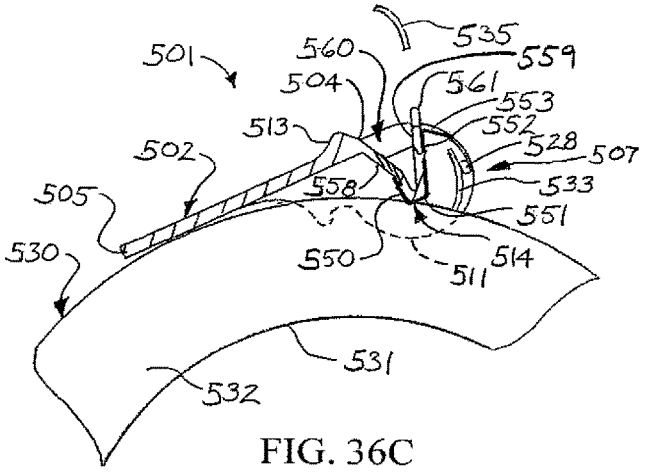
Figure 36D:
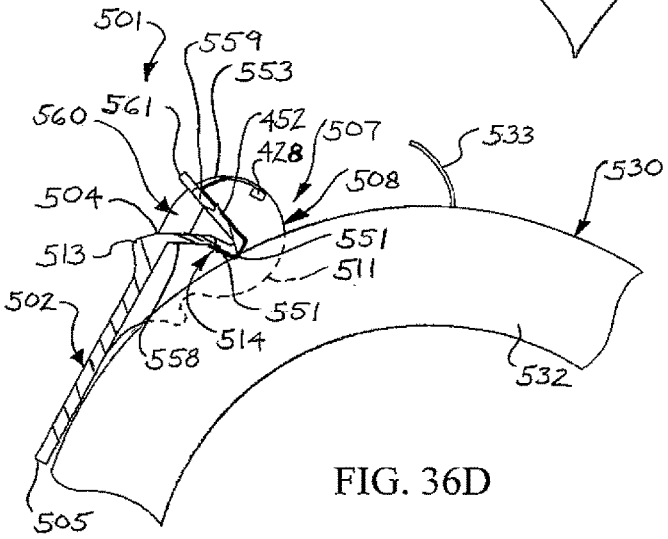

The tape cutting unit 507 is manually slid along the tape roll 530 until the tape cutting blade 514 is located behind and at a selected distance from the free end (not illustrated) of the tape 532, which distance corresponds to the desired length of the tape segment 533 to be cut from the tape 532. The free end of the tape 532 is next located and grasped, and the tape segment 533 which is to be removed is peeled from the underlying portion of the tape 532 wound on the spool 531. As it is removed from the underlying wound tape 532, the tape segment 533 is pulled against and across the tape cutting edge 517 of the tape cutting blade 514, as illustrated in FIG. 36B, such that the blade attachment edge 515 severs the tape segment 533 from the tape 532. The tape cutting edge 517 of the tape cutting blade 514 cuts a straight edge 534 in the tape segment 533 as well as facilitates the cutting of multiple tape segments 533 of selected and uniform or consistent length. The tape cutting device 1 may be subsequently displaced rearwardly on the tape roll 530 by insertion of the user's fingers into the panel gap 560 and/or by grasping the thumb flange 513. The finger guards 561 may protect the user's fingers from contacting the tape cutting blade 514. As illustrated in FIGS. 36C and 36D, upon subsequent rearward displacement of the tape cutting device 501 on the tape roll 530, the tape bending tabs 528 which protrude toward each other from the respective tape roll guides 508 beneath the tape cutting edge 517 may "catch" or engage and pull back the portion of the tape segment 533 which remains attached to the tape roll 530. Thus, the pulled-back tape segment 533 assists the user in finding, grasping and subsequently pulling and cutting the next tape segment 533 from the tape roll 530. The next tape segment 533 can be removed from the tape roll 530 in the similar manner, by positioning the tape cutting device 501 on the tape roll 530 behind and within the distance to the extending tape segment 533 which corresponds to the desired length of the tape segment 533 and then grasping and pulling the tape segment 533 against the tape cutting edge 517 of the tape cutting blade 514 to form the severed tape segment 535 (FIG. 36C), as was heretofore described.

As the tape segments 533 are cut and dispensed from the tape roll 530, the tape cutting device 501 is pushed or "rides" along the tape roll 530 to position the tape cutting edge 517 of the tape cutting blade 514 at the selected positions along the tape 532 for cutting and dispensing of the tape segments 533 of selected length. Throughout use of the tape cutting device 501, the elastic retainer cord 521 of the retainer mechanism 520 is constantly in a contracted state and thus, continually maintains a secure and snug fit of the tape cutting unit 507 against the tape roll 530. Therefore, as the diameter of the tape roll 530 progressively decreases as a result of the tape 532 being gradually dispensed from the spool 531, as was heretofore described with respect to FIGS. 14-16, the retainer cord 521 contracts and continues to snugly secure the tape cutting unit 507 on the tape roll 530 and prevents loosening of the tape cutting unit 507. The retainer mechanism 520 can be selectively tightened, as necessary, by pulling the retainer cord 521 upwardly in the cord slit 525 in the tape cutting unit 507. When all of the tape 532 has been dispensed from the spool 531, the tape cutting unit 507 can be removed from the spool 531 by disengaging the retainer member 522 from the retainer seat 524 in the device panel 502 and removing the retainer cord 521 from one or both of the cord slits 525. The tape cutting device 501 can be subsequently used in a similar manner on a fresh tape roll 530.

While the illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A tape cutting device for cutting tape segments from tape wound on a tape roll, comprising:

a tape cutting unit adapted to ride along the tape roll, the tape cutting unit including:

a device panel;

a pair of spaced-apart tape roll guides extending from the device panel;

a tape cutting blade having a tape cutting edge extending between the tape roll guides; and a pair of tape bending tabs extending from the tape roll guides, respectively, toward each other and in spaced-apart relationship to the tape cutting edge of the tape cutting blade; and a retaining mechanism carried by the tape cutting unit, the retaining mechanism adapted to secure the tape cutting unit on the tape roll, the retaining mechanism comprising a pair of cord slits in the tape cutting unit and at least one elastic retainer cord inserted in the cord slits, the retainer cord adapted to engage the tape roll.

2. The tape cutting device of claim 1 wherein the retaining mechanism further comprises at least one retainer member terminating the at least one elastic retainer cord.

3. The tape cutting device of claim 2 further comprising at least one retainer seat in the tape cutting unit and communicating with at least one of the pair of cord slits.

4. The tape cutting device of claim 1 wherein the device panel comprises a pair of side panel edges and a blade support edge and a tape roll engaging edge extending between the side panel edges, and wherein the tape cutting blade is carried by the blade support edge.

5. The tape cutting device of claim 4 further comprising a first blade mount panel extending along and angling from the blade support edge between the tape roll guides and a second blade mount panel extending along and angling from the first blade mount panel between the tape roll guides, and wherein the tape cutting blade is carried by the first blade mount panel and the second blade mount panel.

6. The tape cutting device of claim 5 further comprising a panel gap between the first blade mount panel and the second blade mount panel.

7. The tape cutting device of claim 5 wherein the tape cutting blade comprises a first blade mount portion carried by the first blade mount panel, a second blade mount portion carried by the second blade mount panel and a tape cutting portion carried by the second blade mount portion, and wherein the tape cutting edge extends along the tape cutting portion.

8. A tape cutting device for cutting tape segments from tape wound on a tape roll, comprising:

a tape cutting unit adapted to ride along the tape roll, the tape cutting unit including:

a device panel;

a pair of spaced-apart tape roll guides extending from the device panel;

a tape cutting blade having a tape cutting edge extending between the tape roll guides;

a thumb flange protruding from the device panel adjacent to the tape cutting blade and a pair of tape bending tabs extending from the tape roll guides, respectively, toward each other and in spaced-apart relationship to the tape cutting edge of the tape cutting blade; and a retaining mechanism carried by the tape cutting unit, the retaining mechanism adapted to secure the tape cutting unit on the tape roll, the retaining mechanism comprising a pair of cord slits in the tape cutting unit and at least one elastic retainer cord inserted in the cord slits, the retainer cord adapted to engage the tape roll.

9. The tape cutting device of claim 8 wherein the retaining mechanism further comprises at least one retainer member terminating the at least one elastic retainer cord.

10. The tape cutting device of claim 9 further comprising at least one retainer seat in the tape cutting unit and communicating with at least one of the pair of cord slits.

11. The tape cutting device of claim 8 wherein the device panel comprises a pair of side panel edges and a blade support edge and a tape roll engaging edge extending between the side panel edges, and wherein the tape cutting blade is carried by the blade support edge.

12. The tape cutting device of claim 11 further comprising a first blade mount panel extending along and angling from the blade support edge between the tape roll guides and a second blade mount panel extending along and angling from the first blade mount panel between the tape roll guides, and wherein the tape cutting blade is carried by the first blade mount panel and the second blade mount panel.

13. The tape cutting device of claim 12 further comprising a panel gap between the first blade mount panel and the second blade mount panel.

14. The tape cutting device of claim 13 wherein the tape cutting blade comprises a first blade mount portion carried by the first blade mount panel, a second blade mount portion carried by the second blade mount panel and a tape cutting portion carried by the second blade mount portion, and wherein the tape cutting edge extends along the tape cutting portion.

15. A tape cutting device for cutting tape segments from tape wound on a tape roll, comprising:

a tape cutting unit adapted to ride along the tape roll, the tape cutting unit including:

a device panel having a pair of side panel edges and a blade support edge and a tape roll engaging edge extending between the side panel edges;

a pair of spaced-apart tape roll guides extending from the device panel;

a first blade mount panel extending along and angling from the blade support edge between the tape roll guides;

a second blade mount panel extending along and angling from the first blade mount panel between the tape roll guides;

a tape cutting blade extending between the tape roll guides, the tape cutting blade including:

a first blade mount portion carried by the first blade mount panel;

a second blade mount portion carried by the second blade mount panel;

a tape cutting portion carried by the second blade mount portion; and a tape cutting edge extending along the tape cutting portion;

a panel gap between the first blade mount panel and the second blade mount panel:

a thumb flange protruding from the device panel adjacent to the panel gap; and a pair of tape bending tabs extending from the tape roll guides, respectively, toward each other and in spaced-apart relationship to the tape cutting edge of the tape cutting blade; and a retaining mechanism carried by the tape cutting unit, the retaining mechanism adapted to secure the tape cutting unit on the tape roll.

16. The tape cutting device of claim 15 wherein the retaining mechanism comprises a pair of cord slits in the tape cutting unit and at least one elastic retainer cord inserted in the cord slits, the retainer cord adapted to engage the tape roll.

17. The tape cutting device of claim 16 wherein the retaining mechanism further comprises at least one retainer member terminating the at least one retainer cord.

18. The tape cutting device of claim 17 further comprising at least one retainer seat in the tape cutting unit and communicating with at least one of the pair of cord slits.

* * * * *